US008646247B2

(12) United States Patent
Frazier

(10) Patent No.: US 8,646,247 B2
(45) Date of Patent: Feb. 11, 2014

(54) METHOD FOR APPLYING TAPE CLOSURE TO A BAG

(75) Inventor: Jimmy R. Frazier, Norman, OK (US)

(73) Assignee: Burford Corp., Maysville, OK (US)

( * ) Notice: Subject to any disclaimer, the term of this patent is extended or adjusted under 35 U.S.C. 154(b) by 386 days.

(21) Appl. No.: 12/892,737

(22) Filed: Sep. 28, 2010

(65) Prior Publication Data

US 2011/0078982 A1 Apr. 7, 2011

Related U.S. Application Data

(60) Provisional application No. 61/246,408, filed on Sep. 28, 2009.

(51) Int. Cl.
*B65B 51/06* (2006.01)

(52) U.S. Cl.
USPC ..... 53/471; 53/419; 53/138.3; 53/139.1

(58) Field of Classification Search
USPC ..... 53/471, 419, 138.3, 138.6, 138.7, 53/139.1, 583, 417
See application file for complete search history.

(56) References Cited

U.S. PATENT DOCUMENTS

| | | | | |
|---|---|---|---|---|
| 1,196,460 | A | 8/1916 | Jessen | |
| 2,840,967 | A * | 7/1958 | Platt et al. | 53/583 |
| 2,867,066 | A * | 1/1959 | Platt et al. | 53/583 |
| 2,882,663 | A * | 4/1959 | Leighton | 53/583 |
| 3,141,277 | A | 7/1964 | Johnston | |
| 3,173,232 | A | 3/1965 | Mercer | |
| 3,375,634 | A | 4/1968 | Valdemar | |
| 4,044,450 | A * | 8/1977 | Raudys et al. | 29/509 |
| 4,242,171 | A | 12/1980 | Kauer et al. | |
| 4,534,149 | A | 8/1985 | Hoyland | |
| 4,537,005 | A | 8/1985 | Hoyland | |
| 4,554,776 | A | 11/1985 | Chikatani | |
| 4,621,479 | A | 11/1986 | Hoyland | |
| 4,660,351 | A | 4/1987 | Saitoh | |
| 4,813,207 | A | 3/1989 | Rundle | |
| 4,856,258 | A | 8/1989 | Burford et al. | |
| 4,912,913 | A | 4/1990 | Rundle | |
| 5,173,140 | A | 12/1992 | Vasilakes | |
| 5,279,094 | A | 1/1994 | Odom et al. | |
| 5,771,664 | A * | 6/1998 | Recchia, Jr. | 53/417 |
| 5,896,726 | A * | 4/1999 | Kellaway | 53/139.1 |
| 6,033,762 | A | 3/2000 | Decker | |
| 6,112,499 | A * | 9/2000 | Lyskawa et al. | 53/138.7 |
| 6,886,310 | B1 | 5/2005 | Bois | |
| 2007/0107378 | A1 | 5/2007 | Frazier | |

* cited by examiner

*Primary Examiner* — Hemant M Desai
(74) *Attorney, Agent, or Firm* — Crowe & Dunlevy

(57) ABSTRACT

A tape closure device is configured to secure the neck of a vertically-oriented bag with an adhesive tape. The tape closure device preferably includes a main plate that has a closure receiving slot and a drive plate connected to the main plate. The drive plate includes a drive assembly receiving slot that is vertically aligned with the closure receiving slot. The tape closure device also includes a drive assembly attached to the drive plate, a tape feed assembly attached to the main plate, and a closure system attached to the main plate. The closure system of the tape closure device includes a front plunger configured for rotation about a first vertical axis, a back plunger configured for rotation about a second vertical axis, a taping arm configured for rotation about a third vertical axis and a receiving block positioned adjacent the closure receiving slot.

7 Claims, 16 Drawing Sheets

METHOD FOR APPLYING TAPE CLOSURE TO A BAG

RELATED APPLICATIONS

The present application claims the benefit of U.S. Provisional Patent Application Ser. No. 61/246,408, filed Sep. 28, 2009, entitled Apparatus and Method for Automated Tape Closure For Vertically Oriented Packages, the disclosure of which is herein incorporated.

FIELD OF THE INVENTION

The present invention is generally related to the field of automated bag closure systems.

BACKGROUND OF THE INVENTION

For many years, manufacturers have used plastic bags to package a wide variety of products. In some industries, it is desirable to provide a plastic bag that can be repetitively opened and sealed by the consumer. For example, bread is often enclosed in a plastic bag that is bound with a twist-tie. The twist-tie closure allows the consumer to open and close the bag multiple times, thereby extending the use of the bag for the life of the product.

Although twist-ties are favored for their inexpensive cost, competing closure mechanisms have also been employed. For example, plastic lock-tabs are frequently used to close plastic bags containing perishable bakery items. Lock-tabs are easy to apply and offer the packager a surface upon which information can be printed. While generally acceptable, lock-tabs are relatively expensive. As an alternative, manufacturers have employed tape closure systems in which the neck of the bag is captured by a piece of one-sided tape. Tape closure systems offer the cost benefits of twist-ties and the ability to print information on the closure provided by lock-tabs.

U.S. Pat. No. 7,484,342, entitled "Apparatus and Method for Automated Tape Closure" issued Feb. 3, 2009 to Jimmy Frazier and assigned to Burford Corporation discloses a tape closure device for securing the neck of a bag with an adhesive film and a non-adhesive backing. Although well-suited for many packages, the method and apparatus disclosed in the Frazier '342 patent are not easily configured for vertically oriented packages. Vertically oriented packages are commonly used for granular or pelletized products that would tend to fall out of horizontally oriented packages. For example, ice, dog food, produce, hard candy and pretzels are commonly packaged in vertically oriented bags.

Many prior art closure systems function by applying a hog ring around the neck of the vertically oriented bag. This method of closing vertically oriented bags suffers from several deficiencies. First, the metal hog ring presents a health risk if accidentally ingested or masticated. Second, the metal hog ring is incapable of bearing identifying indicia. As food contamination concerns arise, more emphasis is being placed on the ability to track food from information contained on packaging materials. Accordingly, there is a need for an improved closure system for vertically oriented bags and packages that overcomes these deficiencies of the prior art.

SUMMARY OF THE INVENTION

In presently preferred embodiment, the invention includes a method and apparatus for applying a tape closure to a bag. The preferred method includes the steps of securing a leading portion of a continuous length of adhesive tape to a contact surface of a taping arm configured for rotation in a first geometric plane and gathering the neck of the bag between first and second opposing plungers configured for rotation in the first geometric plane. The preferred method continues by moving the gathered neck of the bag against a trailing portion of the continuous length of adhesive tape and forcing the gathered neck of the bag and the trailing portion of the continuous length of adhesive tape into a notch in a receiving block sized to accept the neck of the bag. Once the neck of the bag is forced into the notch of the receiving block, the method continues by rotating the taping arm and the leading portion of the adhesive tape behind the neck of the bag. The method continues by closing the tape closure by wiping the leading portion of the adhesive tape onto the trailing portion of the continuous length of adhesive tape and severing the trailing portion of the continuous length of adhesive tape. The preferred method concludes by securing the continuous length of adhesive tape to the taping arm in preparation for a subsequent cycle of operation.

The invention also provides for a tape closure device configured to carry out the preferred method. The tape closure device is configured to secure the neck of a bag with an adhesive tape and is well equipped to tape the neck of vertically-oriented packages. The tape closure device preferably includes a main plate that has a closure receiving slot and a drive plate connected to the main plate. The drive plate includes a drive assembly receiving slot that is vertically aligned with the closure receiving slot. The tape closure device also includes a drive assembly attached to the drive plate, a tape feed assembly attached to the main plate, and a closure system attached to the main plate. The closure system of the tape closure device includes a front plunger configured for rotation about a first vertical axis, a back plunger configured for rotation about a second vertical axis, a taping arm configured for rotation about a third vertical axis and a receiving block positioned adjacent the closure receiving slot.

DETAILED DESCRIPTION OF PREFERRED EMBODIMENTS

In accordance with a preferred embodiment, the present invention includes a tape closure system for use in conjunction with an automated packaging system. Although the preferred embodiment is disclosed for use in a bakery environment, it will be understood that the tape closure device could find utility in a wide variety of other applications.

Figure 1:
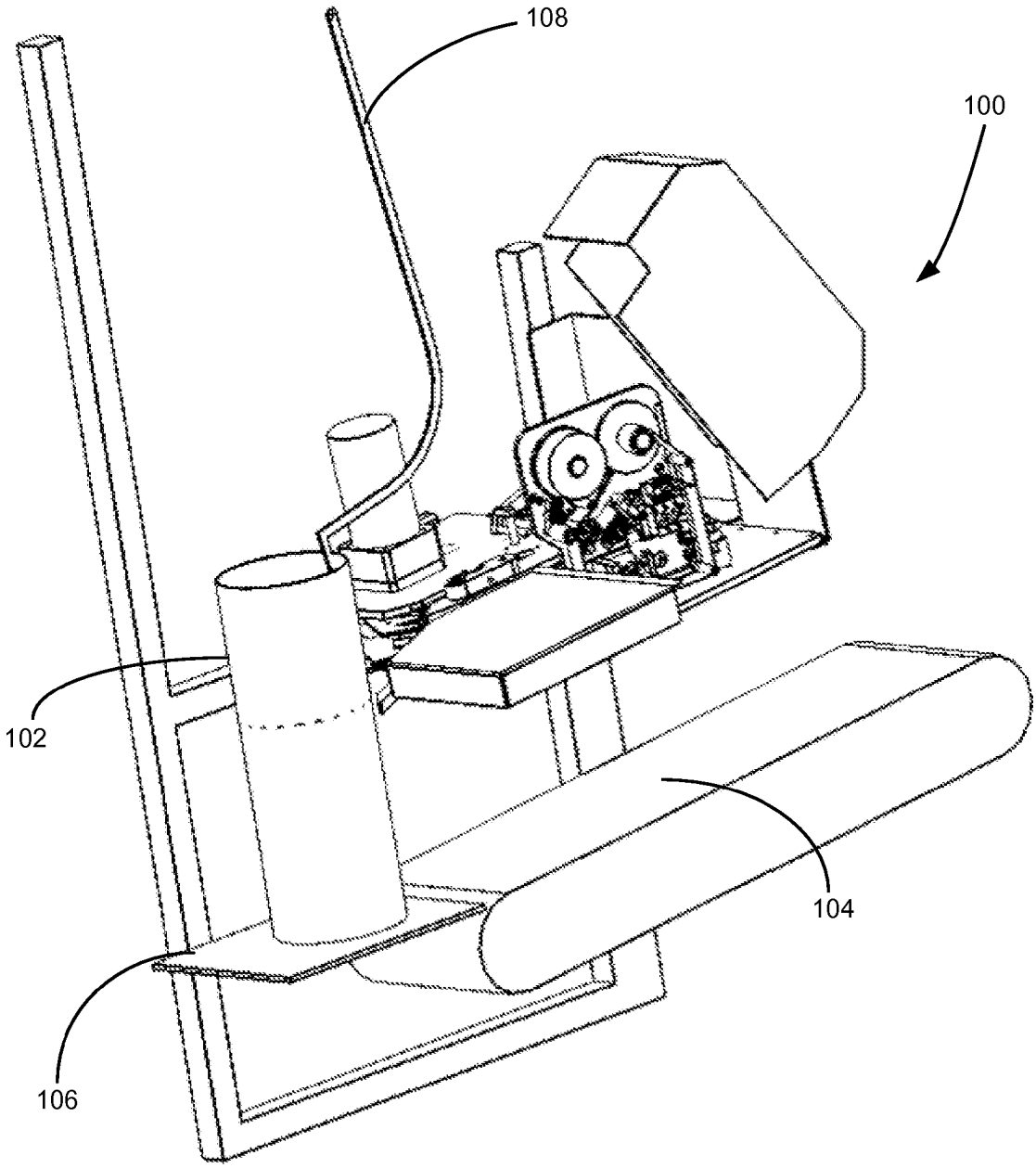
FIG. 1 is a front perspective view of a tape closure device constructed in accordance with a presently preferred embodiment in operation with a conveyor system.

Referring to FIG. 1, shown therein is a perspective drawing of a preferred embodiment of a tape closure device 100. As shown in FIG. 1, the tape closure device 100 can be configured for use in a packaging application that includes a vertically oriented bag 102, a conveyor system 104, a loading platform 106 and a bag unloader 108. During the packaging process, product is deposited into the open bag 102 on the loading platform 106. When filled to the desired extent, the bag unloader 108 catches the open end of the bag 102 and pulls the filled bag 102 onto the conveyor 104. The moving conveyor 104 delivers the loaded bag 102 into the tape closure device 100. In a preferred embodiment, the bag unloader 108 is configured as a "magic finger" that swings back and forth, catching the open edge of the bag 102 in sequence as the bag 102 is filled. Although the tape closure device 100 can be used to close a wide variety of bags 102, the tape closure device 100 is particularly well suited to close vertically oriented bags that are filled with pelletized or particulate products, such as, for example, produce, ice, dog food, hard candy, pretzels or other products that would spill if filled horizontally.

Figure 2:
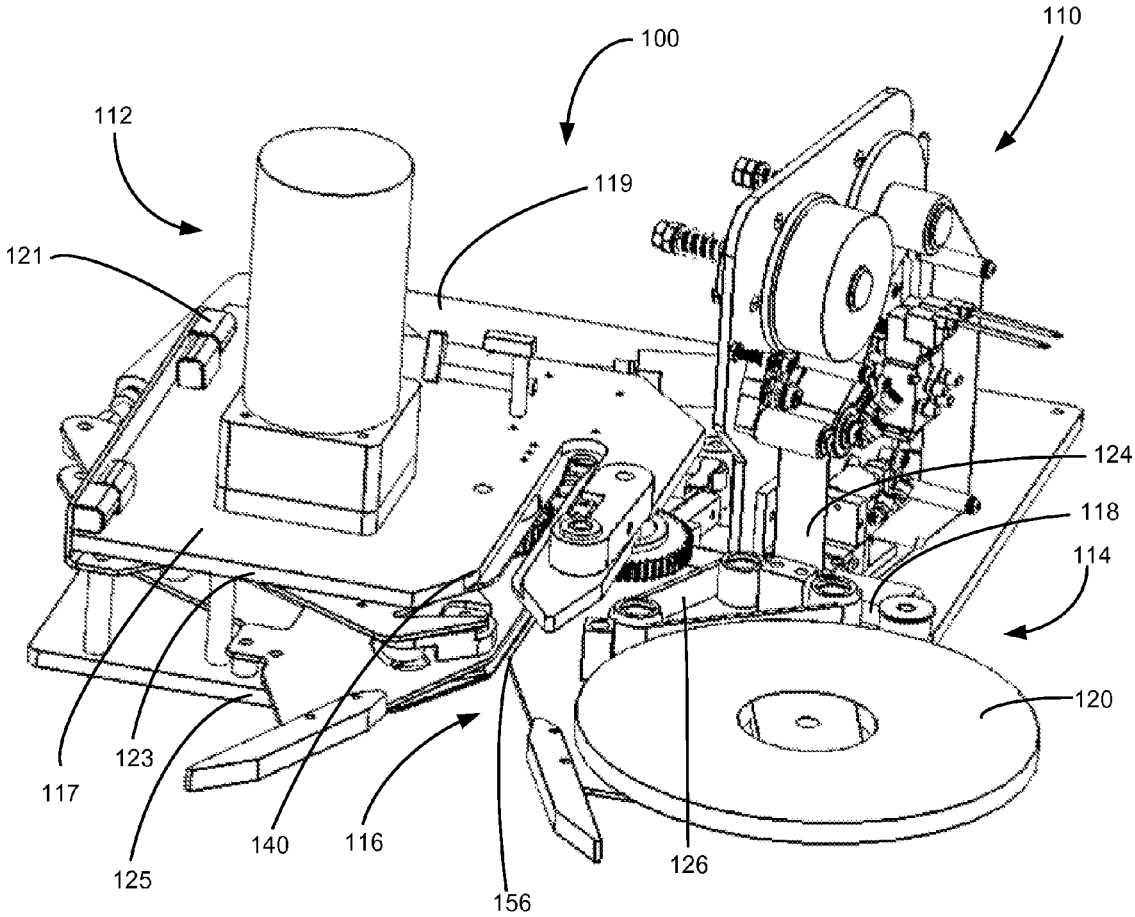
FIG. 2 is a front perspective view of the tape closure device of FIG. 1.

Turning to FIG. 2, shown therein is an isolated view of the tape closure device 100. The tape closure device 100 generally includes a printer assembly 110, a drive assembly 112, a tape feed assembly 114 and a closure system 116. In a presently preferred embodiment, the components of the drive assembly 112 are mounted to a drive plate 117, while the tape feed assembly 114, printer assembly 110 and closure system 116 are mounted to a main plate 119. In the presently preferred embodiment, the drive plate 117 and main plate 119 are horizontally disposed during operation of the tape closure device 100. The drive plate 117 may be connected to the main plate 119 with a plurality of hinges 121 that are configured to permit the pivoted separation of the drive plate 117 from the main plate 119.

Figure 5:
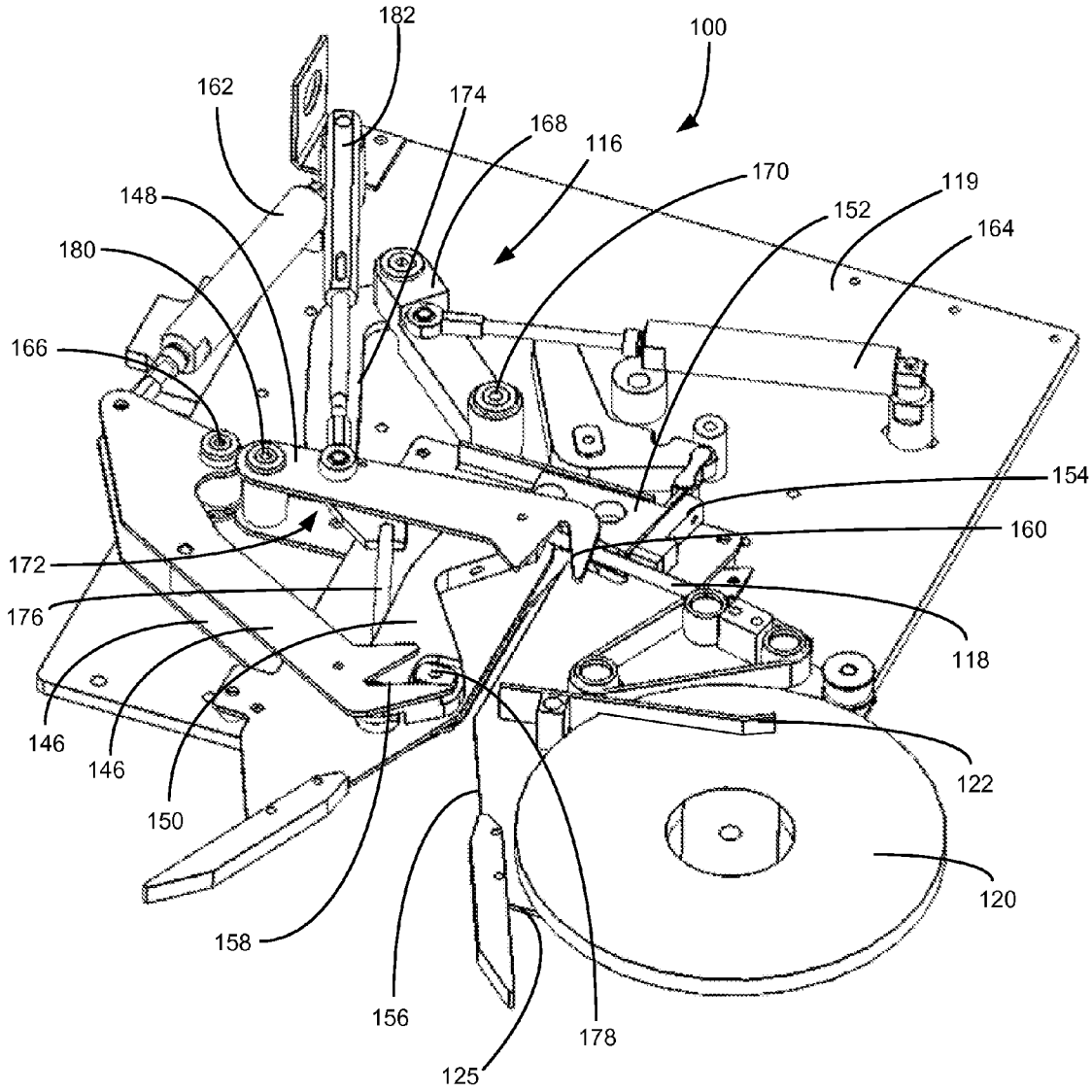
FIG. 5 is a top perspective view of the closure system of the tape closure device of FIG. 2.

The tape feed system 114 includes tape 118, a spool 120 and a drag arm 122 (shown in FIG. 5). Tape 118 is fed from a spool 120 in the tape feed system 114 through the printer assembly 110 to the closure system 116. In a presently preferred embodiment, the tape 118 is configured as one-sided tape, with a single side containing adhesive. The non-adhesive side is preferably configured to receive printed indicia.

The printer assembly 110 is preferably configured to print desired information (e.g., date, location, batch) on the tape delivered from the tape feed assembly 114. The printer assembly 110 includes a computerized printer 124 and a printer belt 126. Tape 118 passes between the printer belt 126 and a print head located on the printer 124. The printer 124 selectively imprints the tape 118 by pressing the print head against the tape 118 and printer belt 126. As the tape 118 advances through the printer 124, the tape 118 momentarily adheres to the printer belt 126, which rotates with the motion of the tape 118. The printer belt 126 is preferably manufactured from a silicone material that releases the tape 118 without adversely affecting tackiness.

Figure 3:
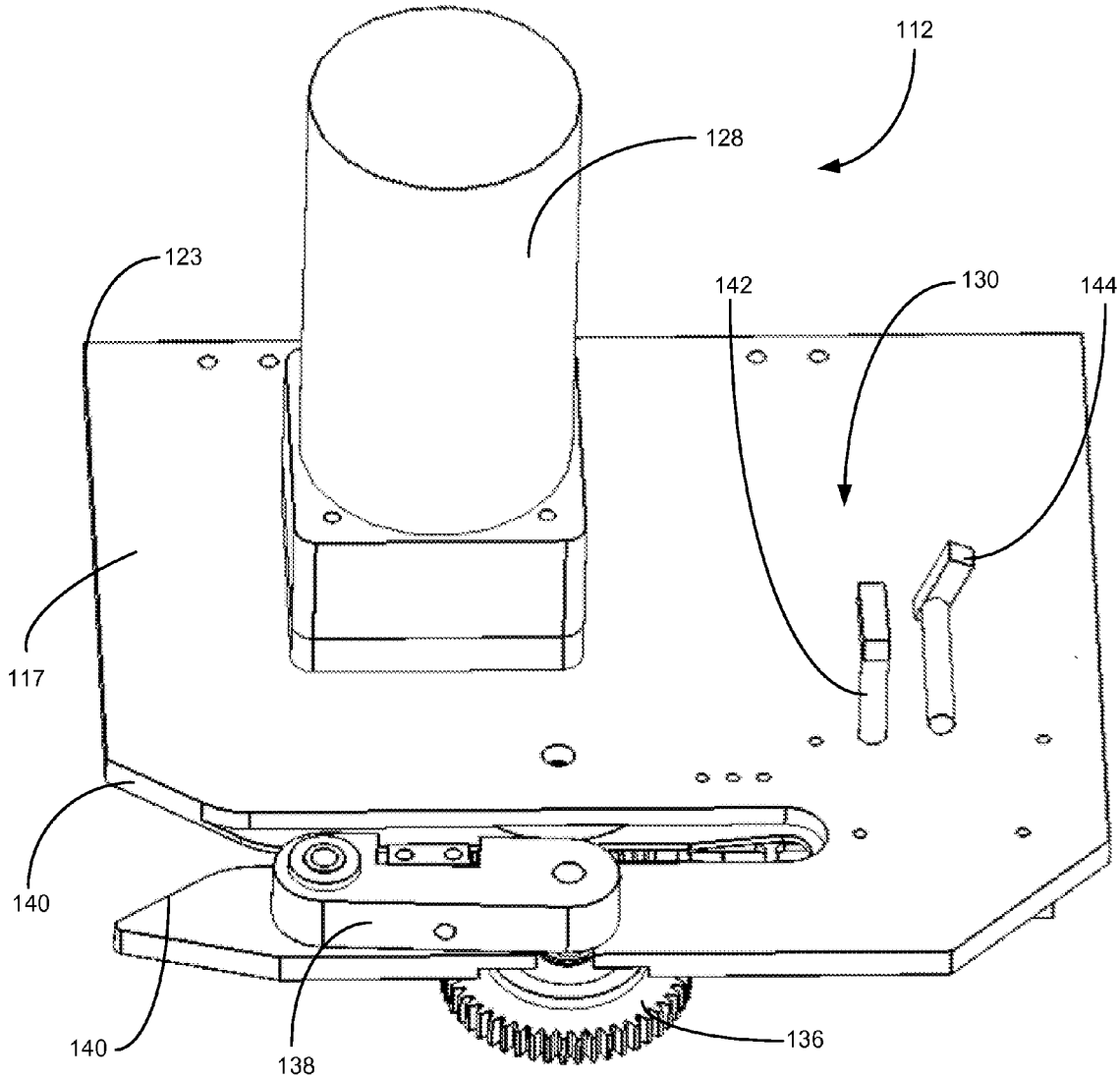
FIG. 3 is a top perspective view of the drive assembly of the tape closure device of FIG. 2.
Figure 4:
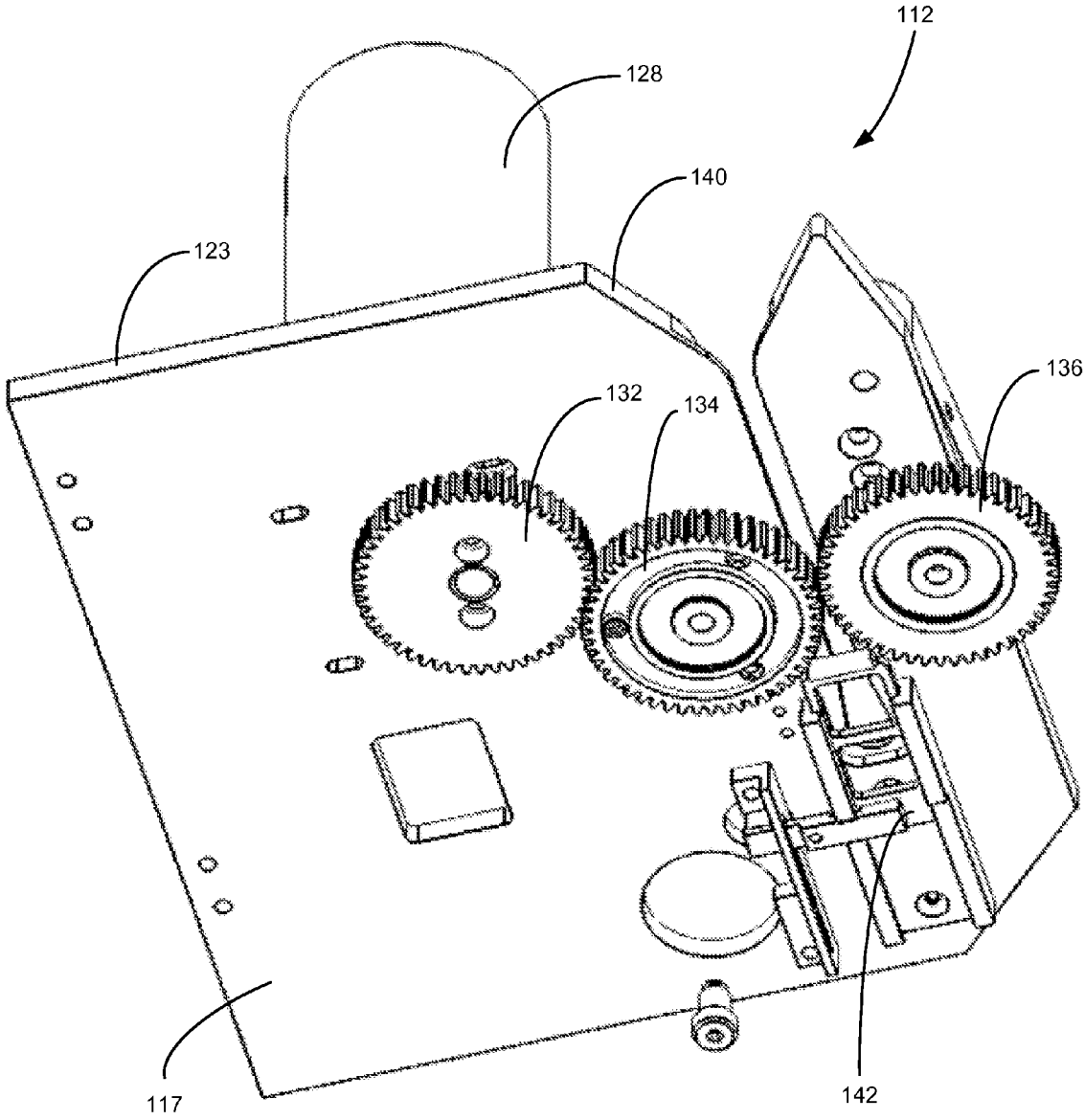
FIG. 4 is a bottom perspective view of the drive assembly of the tape closure device of FIG. 2.

Turning to FIGS. 3 and 4, shown therein are top perspective and bottom perspective views, respectively, of the drive assembly 112 isolated from the balance of the components of the tape closure device 100. The drive assembly 112 generally functions by forcing the neck of the bag 102 into the closure system 116. The drive assembly 112 generally includes a motor 128, a proximity sensor assembly 130, drive gears 132, 134, a passive gear 136 and a clutch 138. The motor 128 is preferably configured as an electric motor that is coupled directly to the drive gears 132, 134. The drive gear 132 transfers the movement from the motor 128 to the drive gear 134, which in turn drives passive gear 136. Passive gear 136 is connected to the clutch 138, which permits the passive gear 136 to translate away from drive gear 134. In operation, the bag 102 passes between the drive gear 134 and passive gear 136 through a drive assembly receiving slot 140. As the bag 102 passes between the adjacent gears, the clutch 138 permits the momentary disengagement of the passive gear 136 to prevent the bag 102 from becoming lodged between the gears. The drive assembly receiving slot 140 is a vertically oriented slot that extends through the drive plate 117 from a leading side 123 of the drive plate 117 to a central portion of the drive plate 117.

The proximity sensor assembly 130 includes a slide 142 and at least one proximity sensor 144. As the bag 102 passes through the drive gear 134 and passive gear 136, the bag 102 contacts the slide 142, which moves back with the motion of the bag 102. The movement of the slide 142 is detected by the proximity sensor 144. The proximity sensor 144 outputs a signal to a controller (not shown) to indicate the presence of the bag 102 in the correct position for closure. In response, the controller initiates a closure cycle. When the bag 102 is no longer in contact with the slide 142, it returns to its home position. The movement of the slide 142 to the home position causes the proximity sensor 144 to output a second signal to the controller indicating that the neck of the bag 102 has been removed from the closure system 116.

Figure 6:
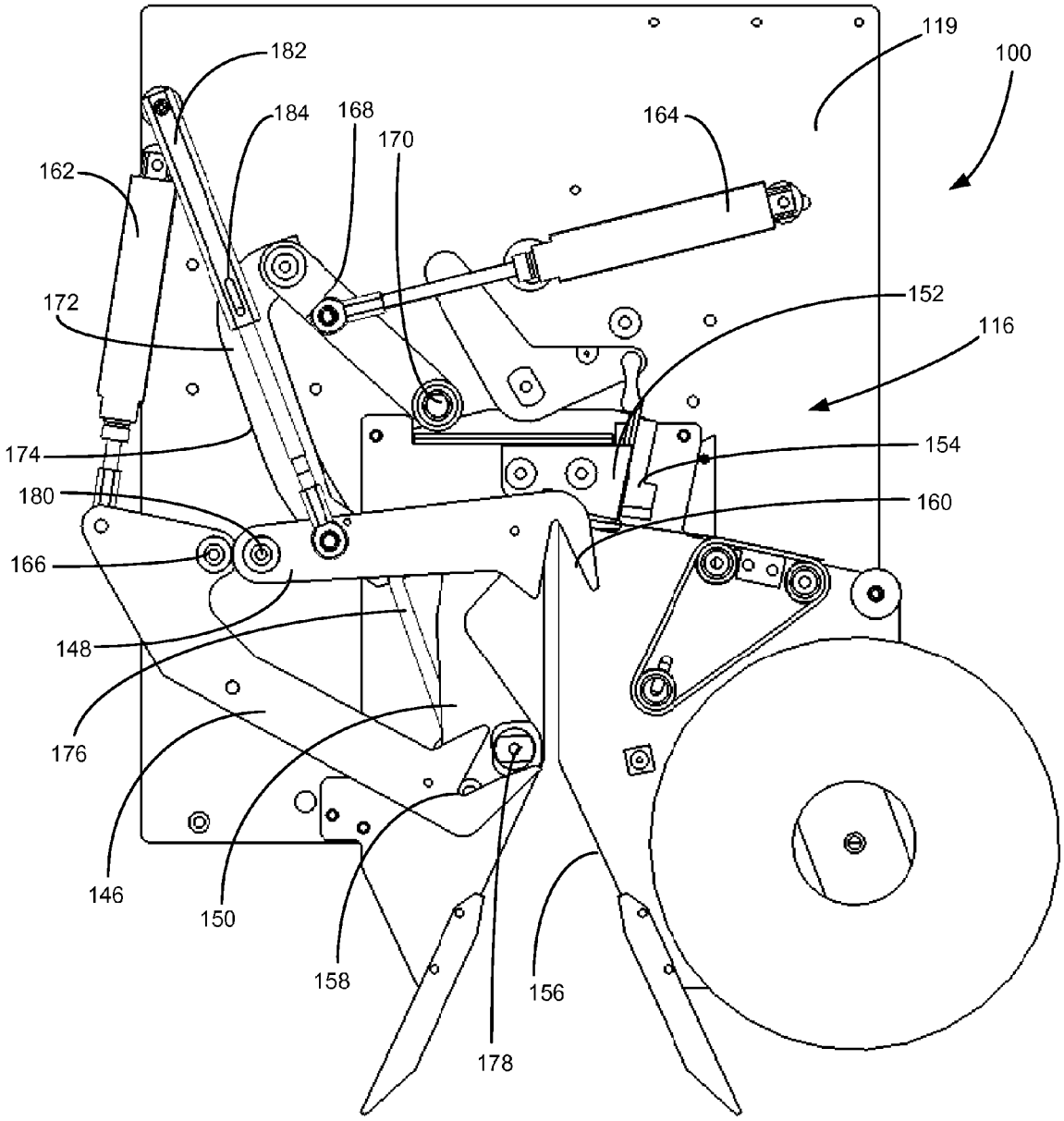
FIG. 6 is a top plan view of the closure system of the tape closure device of FIG. 2.

Turning to FIGS. 5 and 6, shown therein are top perspective and top plan views, respectively, of the tape closure device 100 with the printer assembly 110 and drive assembly 112 removed to better illustrate the closure system 116. The closure system 116 includes a front plunger 146, a back plunger 148, a taping arm 150, a receiving block 152, a cutter arm 154 and a closure receiving slot 156. The front plunger 146 is configured as a two-piece arm that includes a mouth 158. Similarly, the back plunger 148 is configured a two-piece arm that includes a mouth 160. The mouths 158, 160 are sized and configured to gather and hold the neck of the bag 102 during a closure operation. The closure receiving slot 156 is a vertically oriented slot that extends through the main plate 119 from a leading side 125 of the main plate 119 to a central portion of the main plate 119. When the drive plate 117 is positioned over the main plate 119, the drive assembly receiving slot 140 is brought into vertical, spaced-apart alignment with the closure receiving slot 156, as best seen in FIG. 2.

The closure system 116 further includes a first drive cylinder 162 and a second drive cylinder 164. The drive cylinders 162, 164 are preferably configured as double-action, pneumatic cylinders that are configured for pivotal movement about a proximal end. The distal end of the first drive cylinder 162 is connected to the front plunger 146. With the extension and retraction of the first drive cylinder 162, the front plunger 146 pivots about first plunger pivot point 166.

The distal end of the second drive cylinder 164 is connected to a transfer linkage 168 that pivots around a transfer linkage pivot point 170. The free end of the transfer linkage 168 is in turn connected to a taping arm linkage 172. The taping arm linkage 172 includes a curved portion 174 and a rod 176. The curved portion 174 allows the taping arm linkage 172 to rotate through a line of action that passes through transfer linkage pivot point 170. The rod 176 of the taping arm linkage 172 is connected to the taping arm 150, which in turn pivots around taping arm pivot point 178. When the second drive cylinder 164 is extended, the transfer linkage 168 rotates in a counterclockwise direction, which causes the taping arm 150 to also rotate in a counterclockwise direction. Conversely, when the second drive cylinder 164 is retracted, the transfer linkage 166 and taping arm linkage 172 cause the taping arm 150 to rotate in a clockwise direction. In this way, the free end of the taping arm 150 can be made to swing back and forth in front of the receiving block 152 through the alternating extension and retraction of the second drive cylinder 164.

The back plunger 148 pivots about a back plunger pivot point 180 that is adjacent to the front plunger pivot point 166. In this way, the front plunger 146 and back plunger 148 rotate along similar arcuate paths. The back plunger 148 is connected to a spring loaded arm 182. The spring loaded arm 182 includes an internal stop 184. As the back plunger 148 rotates counterclockwise in response to contact with a bag 102, the spring loaded arm 182 compresses until the internal stop 184 is reached. Once the bag 102 is no longer in the mouth 160 of the back plunger 148, the spring loaded arm 182 extends until the internal stop 184 is reached in the opposite direction.

Figure 7:
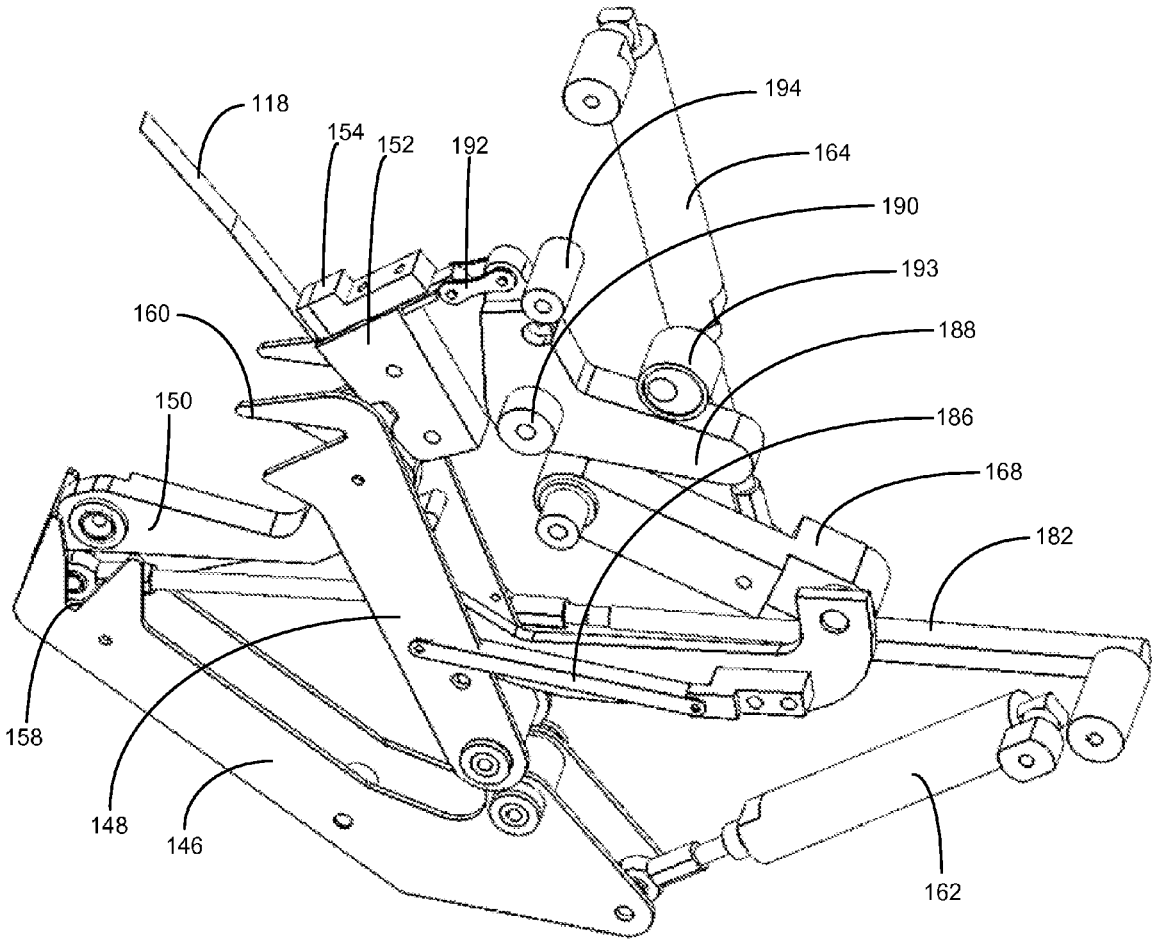
FIG. 7 is a bottom perspective view of the closure system of the tape closure device of FIG. 2.

FIG. 7 provides a bottom view of the closure system 116. As shown in FIG. 7, the closure system 116 further includes a release linkage 186 connected between the bottom piece of the back plunger 148 and the curved portion 174 of the taping arm linkage 172. When the second drive cylinder 164 retracts during closure operation, the release linkage 186 pulls the back plunger 148 backward against the spring force of the spring loaded arm 182. The backward movement of the back plunger 148 facilitates the release of the bag 102 from the mouth 160 of the back plunger.

Figure 8:
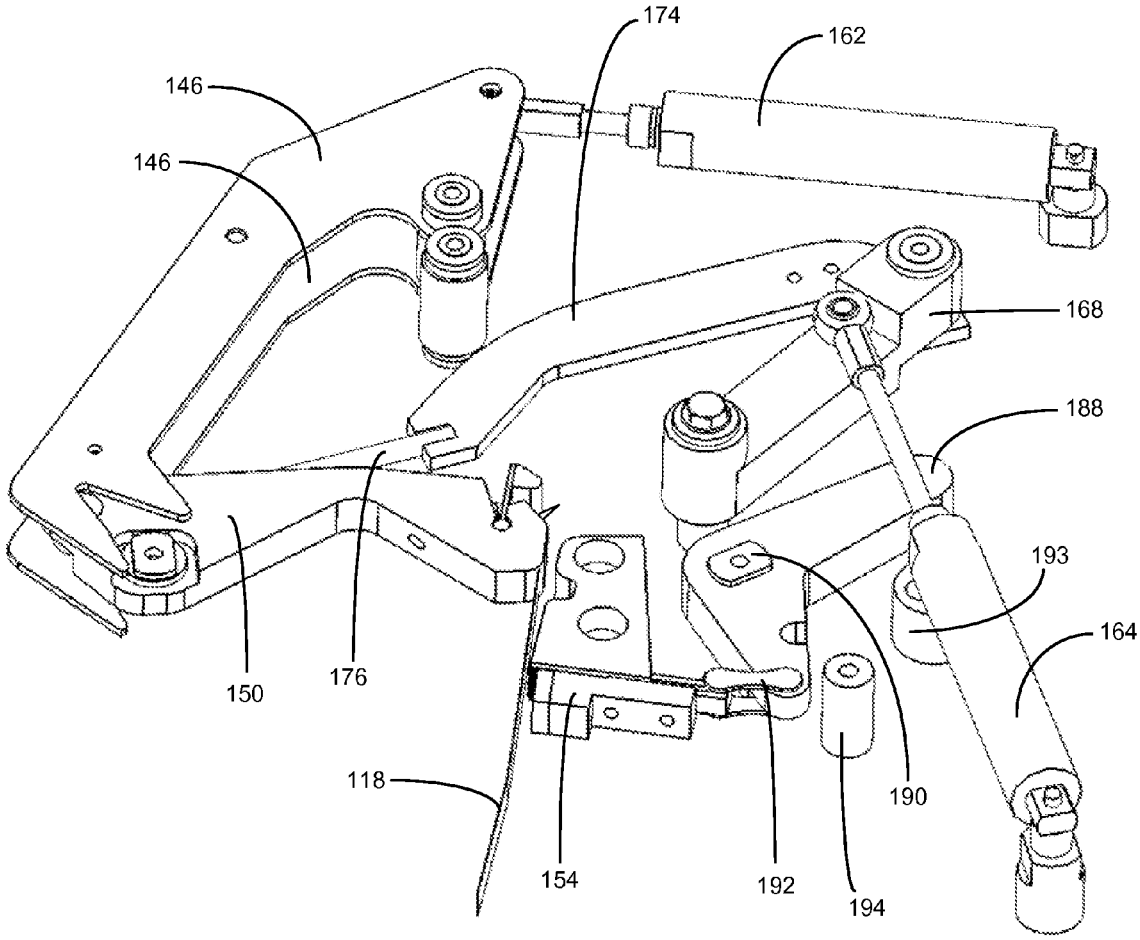
FIG. 8 is a top perspective view of the closure system of the tape closure device of FIG. 2 with the back plunger removed.

FIG. 8 provides a top perspective view of the closure system 116 with the back plunger 148 and spring loaded arm 182 removed for clarity. The cutter arm 154 is preferably configured for sliding engagement along the side of the receiving block 152. In a particularly preferred embodiment, the cutter arm 154 fits in a "T-slot" on the side of the receiving block 152. As the transfer linkage 168 rotates in a clockwise direction and the second drive cylinder 164 retracts during a closure cycle, the transfer linkage 168 contacts a cutter linkage 188. The cutter linkage 188 is preferably configured as a "v-shaped" block that pivots about a cutter linkage pivot point 190. The extent of the rotation of the cutter linkage 188 is stopped by an eccentric cam 193. The eccentric cam 193 can be selectively rotated to adjust the extent of the cutter linkage 188 rotation.

A transfer link 192 connects the cutter linkage 188 with the cutter arm 154. As the cutter linkage 188 rotates, the transfer link 192 transfers the rotational movement of the cutter linkage 188 to the linear, sliding movement of the cutter arm 154. When the second drive cylinder 164 extends at the end of a closure cycle, a spring (not shown) returns the cutter linkage 188 to a home position. A cutter linkage stop 194 limits the retraction of the cutter linkage 188 and cutter arm 154.

Figure 9:
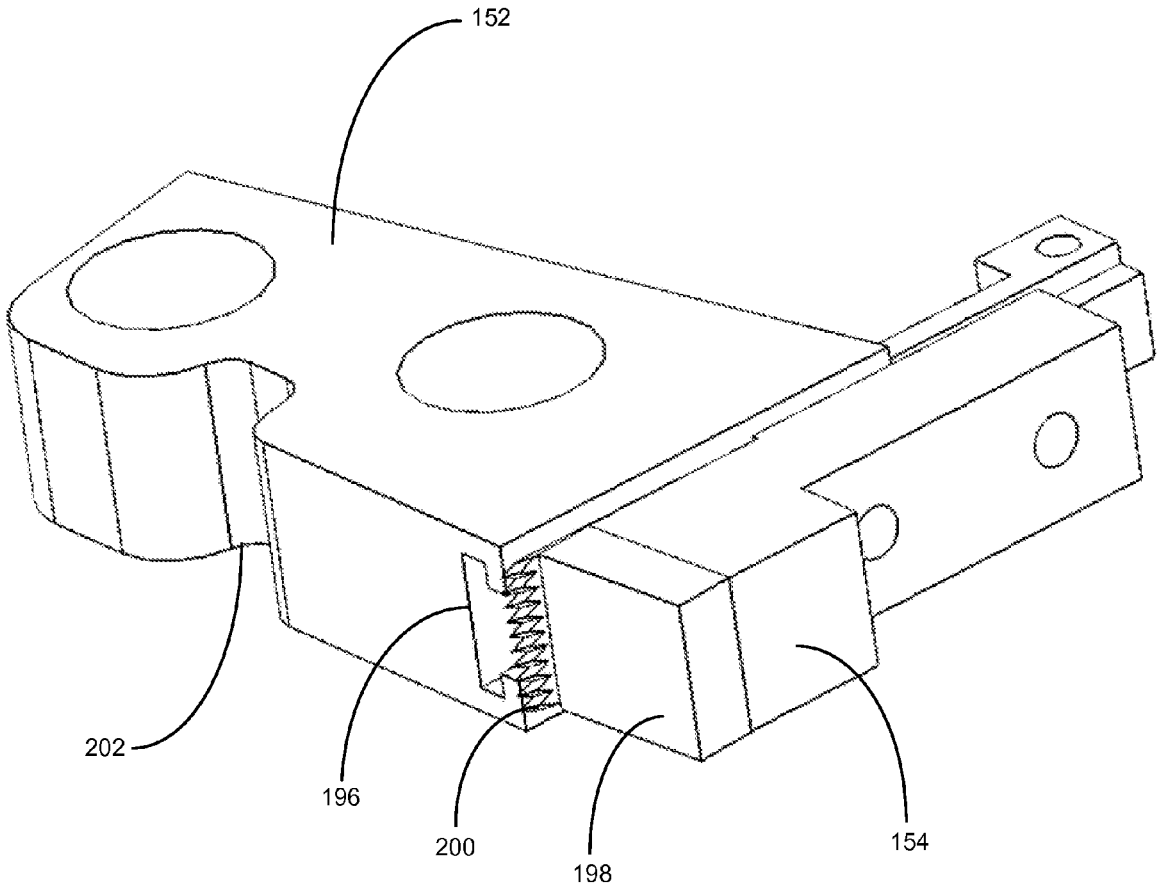
FIG. 9 is a perspective view of the cutter arm of the closure system of FIG. 2.

FIG. 9 provides a close-up perspective view of the receiving block 152 and cutter arm 154. As noted above, the cutter arm 154 rides in a "T-slot" 196 in the receiving block 152. The cutter arm 154 includes a stamp 198 and a blade 200. The receiving block 152 includes a receiving block notch 202 that is configured to assist in the gathering of the neck of the bag 102.

Figure 10:
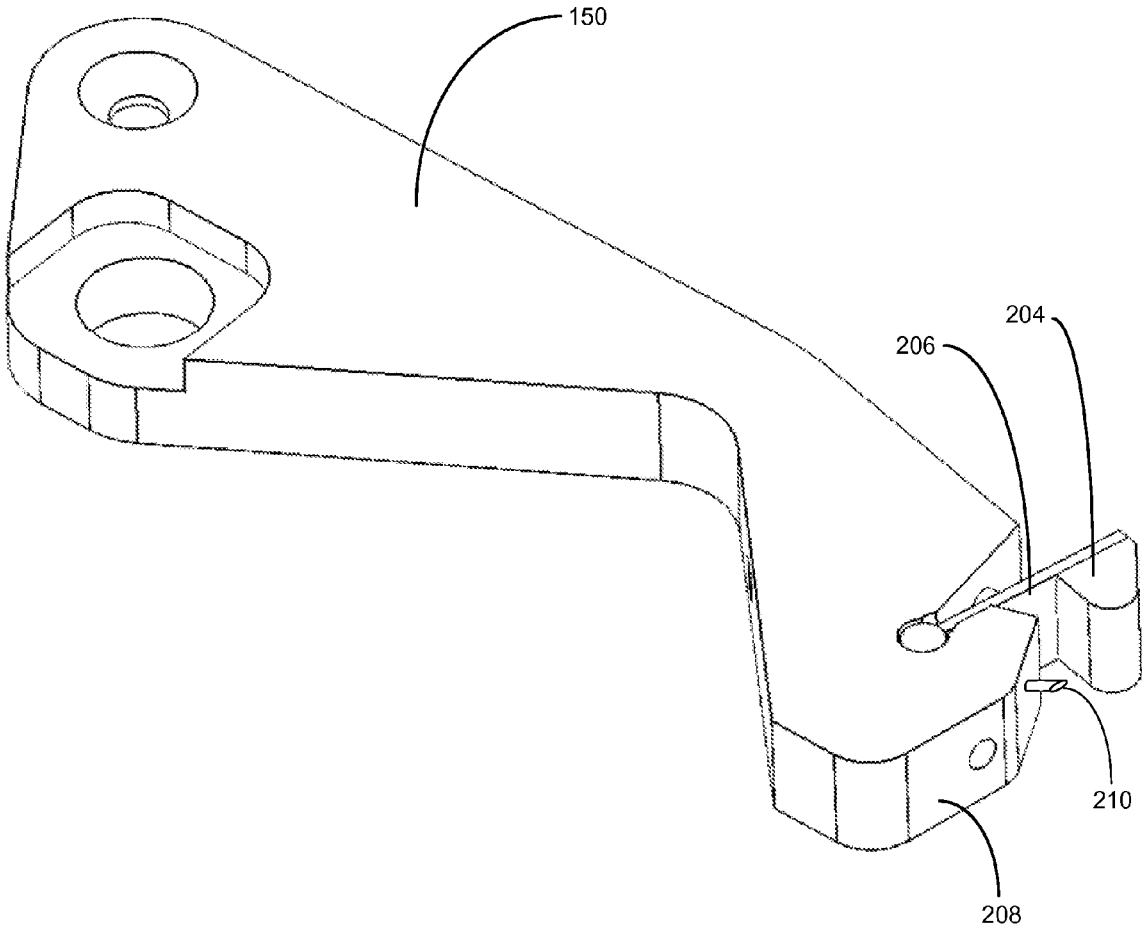
FIG. 10 is a perspective view of the taping arm of the closure system of FIG. 2.

Turning to FIG. 10, shown therein is a perspective view of the taping arm 150. The taping arm 150 includes a wiper 204, a spring 206 and a contact surface 208. The wiper 204 is biased outward by the spring 206. As shown in FIG. 8, the tape 118 is attached to the contact surface 208 before a closure cycle. The tape extends in front of the receiving block 152, receiving block notch 202, blade 200 and stamp 198.

The taping arm 150 optionally includes a spike 210 extending from the face adjacent the contact surface 208. The spike 210 protrudes slightly above the plane of the contact surface 208 and provides a mechanism for aggressively securing the tape 118. During use, the spike 210 punctures the tape 118 to aggressively grip the tape 118. The spike 210 ensures that the tape 118 is adhered to the contact surface 208 and advanced for the next bag 102. The spike 210 find particular utility in those applications in which the tape closure device 100 is used in wet environments which decrease the adhesive characteristics of the tape 118.

Figure 11:
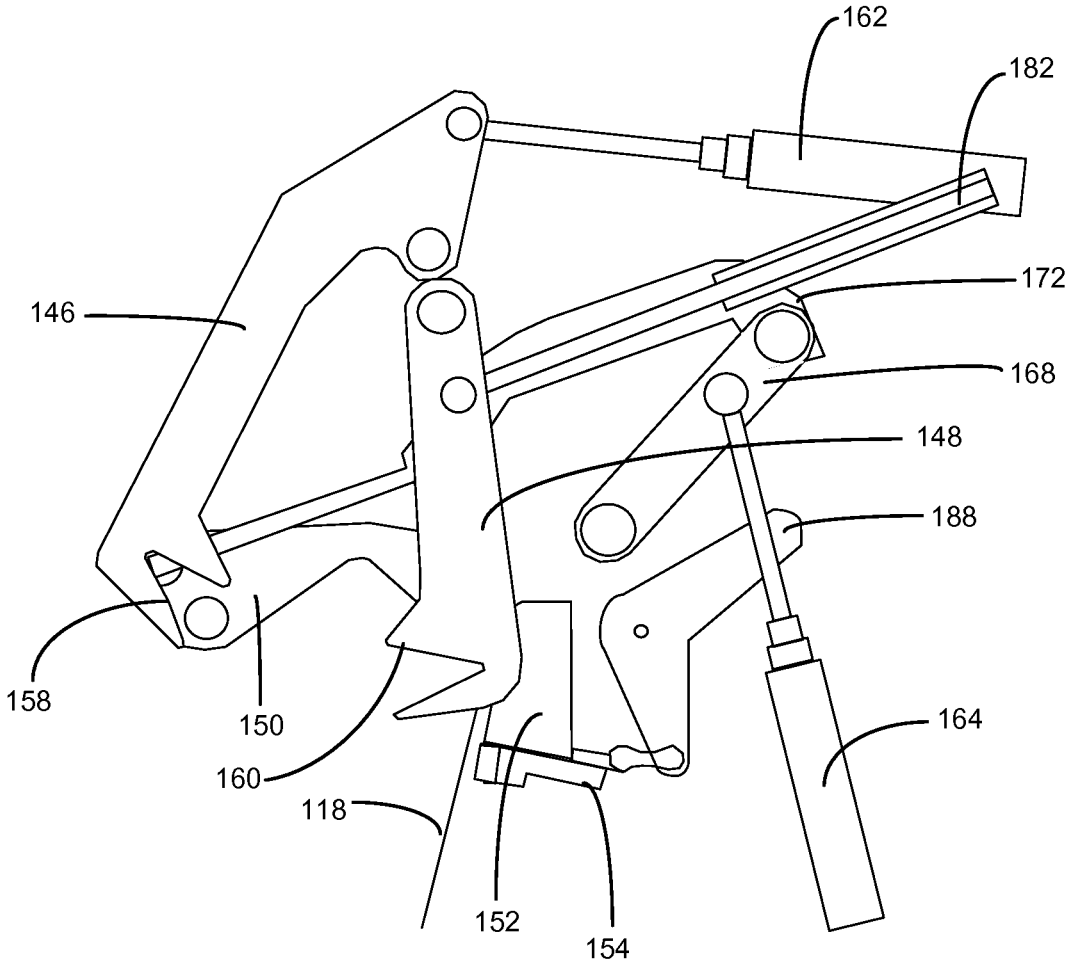
FIGS. 11-16 present simplified illustrations of the closure system during various stages of operation.
Figure 12:
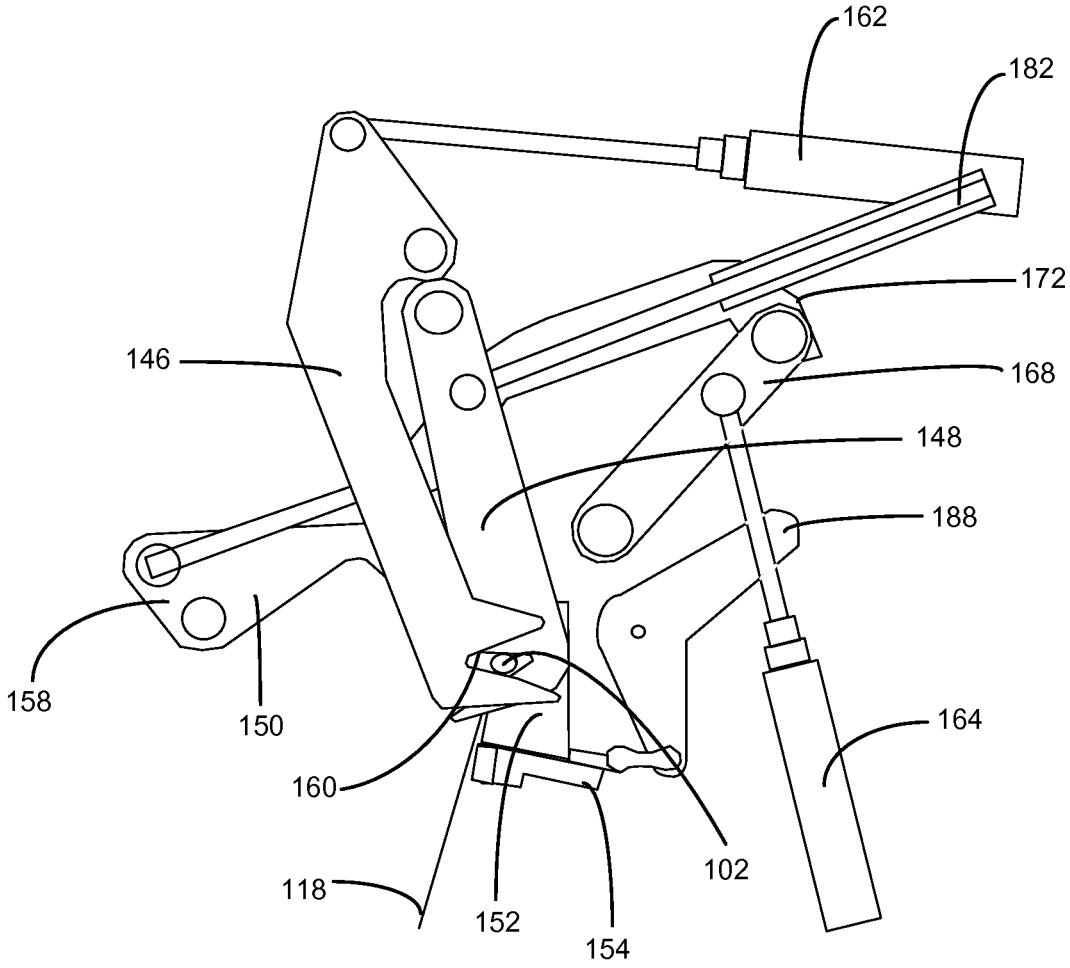
Figure 13:
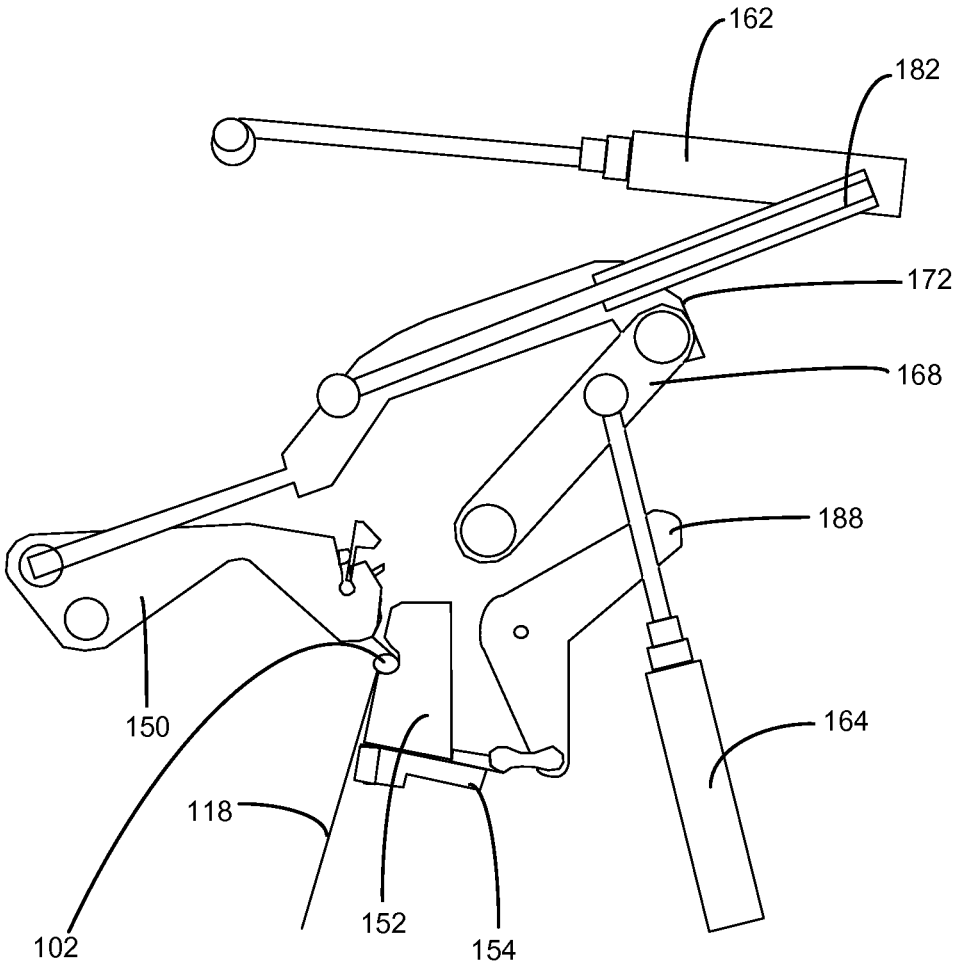

The operation of the tape closure device 100 will now be described with reference to the components within the closure system 116. FIGS. 11-16 present simplified representations of the closure system 116 with many of the peripheral components removed. FIG. 11 illustrates the position of the elements of the closure system 116 at the beginning of the closure cycle. The tape 118 is attached to the contact surface 208 on the taping arm 150 and spike 210. When the sensor assembly 130 detects the presence of a bag 102, the proximity sensor signals the controller to initiate a closure cycle. As the bag 102 is captured in the mouth 160 of the back plunger 148, the first drive cylinder 162 extends, causing the front plunger 146 to rotate into a closed position around the neck of the bag 102, as shown in FIG. 12. The bag 102 contacts the adhesive side of the tape 118 leading to the contact surface 208 of the taping arm 150. To better illustrate the routing of the tape 118 at this point in the closure cycle, the front and back plungers 146, 148 have been removed in FIG. 13.

Figure 14:
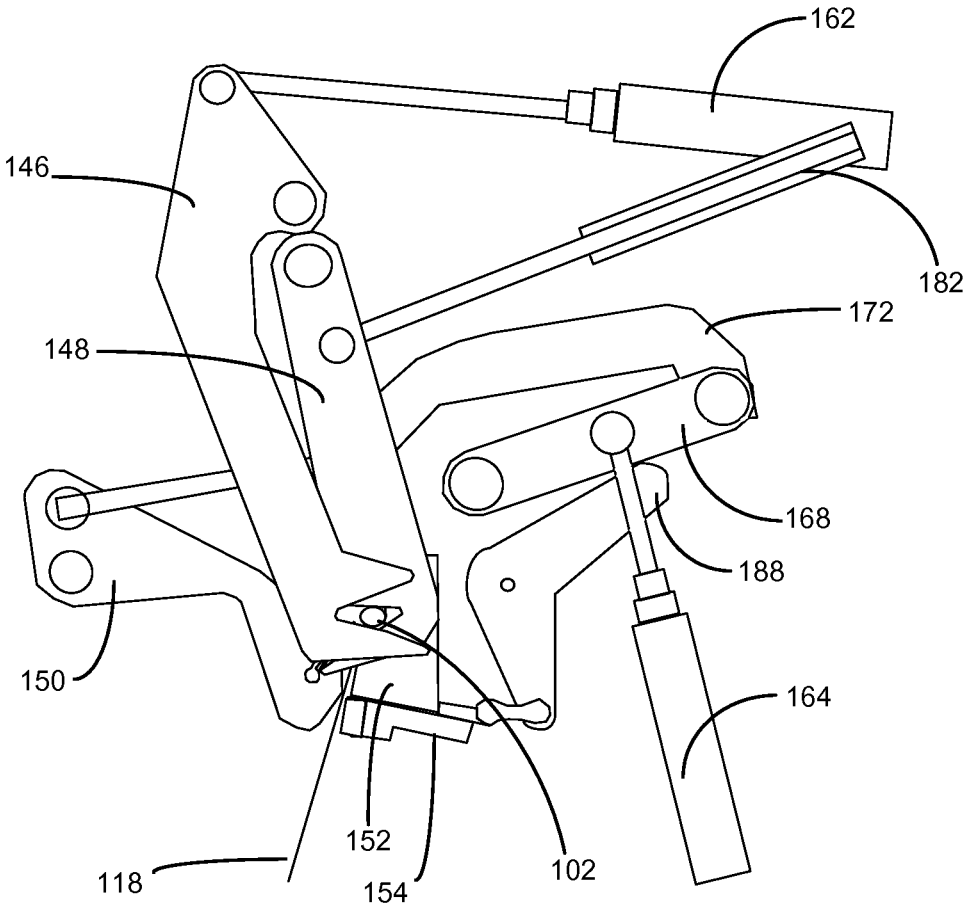
Figure 15:
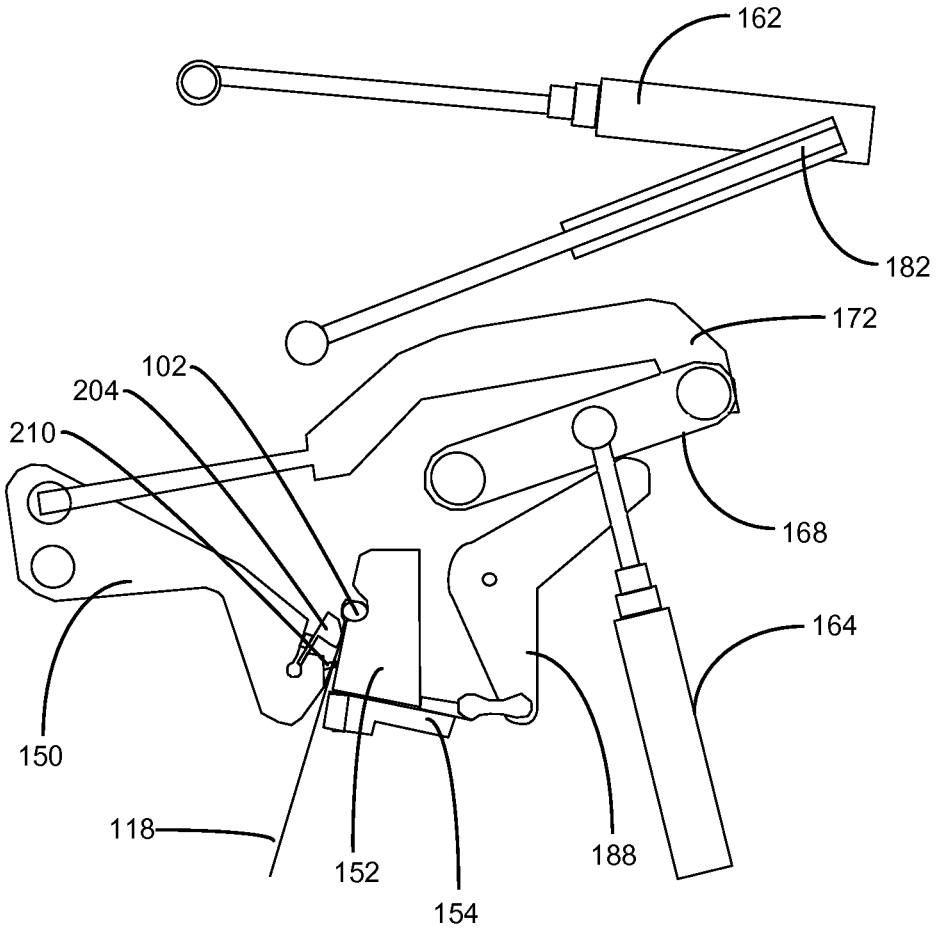

Once the neck of the bag 102 is gathered between the front and back plungers 146, 148 and held in the receiving block notch 202, the second drive cylinder 164 retracts, as shown in FIG. 14, thereby pulling the taping arm 150 across the back side of the neck of the bag 102. To better illustrate the routing of the tape 118 at this point in the closure cycle, the front and back plungers 146, 148 have been removed in FIG. 15. As the taping arm 150 swings across the receiving block 152, the tape secured to the contact surface 208 wraps around the back of the neck of the bag 102. The spring-biased wiper 204 pushes the tape 118 onto itself, thereby closing the tape loop around the neck of the bag 102.

Figure 16:
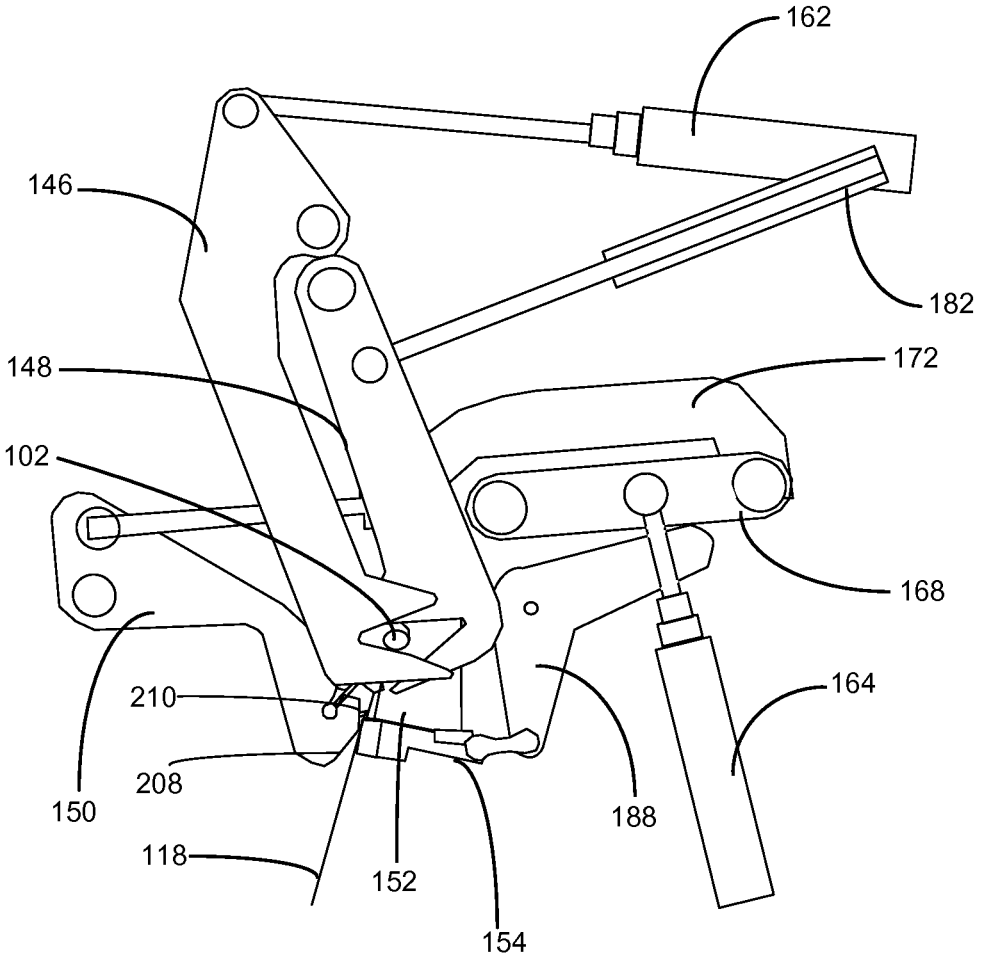

Next, in FIG. 16, as the second drive cylinder 164 continues to retract, the transfer linkage 168 contacts the cutter linkage 188. The rotation of the cutter linkage 188 is transferred into linear movement of the cutter arm 154 by the transfer link 160. As the cutter arm 154 deploys, the blade 200 severs the tape 118 while the stamp 198 presses the leading edge of the tape 118 against the contact surface 208 and spike 210 of the taping arm 150. At approximately the same time, the release linkage 186 (not shown), causes the back plunger 148 to retract, thereby allowing the closed bag 102 to fall from the receiving block notch 202. The sensor assembly 130 detects the absence of a bag 102 and signals the controller to return the closure system 116 to the home position in anticipation of a subsequent closure cycle. As the taping arm 150 rotates back to its home position shown in FIG. 11, the tape 118, now secured against the contact surface 208 and spike 210, is drawn across the front of the receiving block notch, as shown in FIG. 8.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms expressed herein. It will be appreciated by those skilled in the art that the teachings of the present invention can be applied to other systems without departing from the scope and spirit of the appended claims.

It is claimed:

1. A method for applying a tape closure to a bag, the method comprising the steps of:

securing a leading portion of a continuous length of adhesive tape to a contact surface of a taping arm configured for rotation in a first geometric plane;

gathering the neck of the bag between first and second opposing plungers configured for rotation in the first geometric plane;

moving the gathered neck of the bag against a trailing portion of the continuous length of adhesive tape;

forcing the gathered neck of the bag and the trailing portion of the continuous length of adhesive tape into a notch in a receiving block sized to accept the neck of the bag;

rotating the taping arm and the leading portion of the adhesive tape behind the neck of the bag;

closing the tape closure by wiping the leading portion of the adhesive tape onto the trailing portion of the continuous length of adhesive tape;

severing the trailing portion of the continuous length of adhesive tape; and securing the continuous length of adhesive tape to the taping arm in preparation for a subsequent cycle of operation.

2. The method of claim 1, wherein the step of gathering the neck of the bag comprises activating a drive gear and a passive gear to move the neck of the bag through a drive assembly receiving slot and closure receiving slot.

3. The method of claim 2, wherein the step of moving the gathered neck comprises the additional steps of:

activating a first drive cylinder to move a front plunger against the neck of the bag; and receiving the neck of the bag in a back plunger.

4. The method of claim 1, wherein the step of rotating the taping arm comprises the additional step of activating a second drive cylinder to move a transfer linkage and a taping arm linkage, wherein the movement of the transfer linkage and taping arm linkage causes the taping arm to rotate.

5. The method of claim 4, wherein the step of severing the trailing portion of the continuous length of adhesive tape comprises the additional steps of:

retracting the second drive cylinder;

forcing the transfer linkage to contact a cutter linkage; and moving a cutter arm with the cutter linkage to sever the continuous length of adhesive tape.

6. The method of claim 5, wherein the step of securing the continuous length of adhesive tape to the taping arm comprises the additional step of moving the cutter arm with the cutter linkage to force a stamp to press the continuous length of adhesive tape to a contact portion of the taping arm.

7. The method of claim 6, wherein the step of securing the continuous length of adhesive tape to the taping arm comprises the additional step of forcing the continuous length of adhesive tape over a spike positioned adjacent the contact area of the taping arm to provide an enhanced connection between the continuous length of adhesive tape and the taping arm.

* * * * *